US011480911B2

(12) United States Patent
Portnoy et al.

(10) Patent No.: US 11,480,911 B2
(45) Date of Patent: Oct. 25, 2022

(54) PRINT OPERATIONS COMPRISING USER SPECIFIED PRINTING TASKS AND CLEANING OPERATIONS

(71) Applicant: HP Indigo B.V., Amstelveen (NL)

(72) Inventors: Vitaly Portnoy, Ness Ziona (IL); Michel Assenheimer, Ness Ziona (IL); Yoav Nachmias, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 432 days.

(21) Appl. No.: 16/332,442

(22) PCT Filed: Oct. 6, 2016

(86) PCT No.: PCT/EP2016/073936
§ 371 (c)(1),
(2) Date: Mar. 12, 2019

(87) PCT Pub. No.: WO2018/065062
PCT Pub. Date: Apr. 12, 2018

(65) Prior Publication Data
US 2021/0286293 A1 Sep. 16, 2021

(51) Int. Cl.
*G03G 21/00* (2006.01)
*G03G 15/20* (2006.01)
*G03G 15/23* (2006.01)

(52) U.S. Cl.
CPC ..... *G03G 21/00* (2013.01); *G03G 15/2025* (2013.01); *G03G 15/23* (2013.01)

(58) Field of Classification Search
CPC ..... G03G 15/5079
See application file for complete search history.

(56) References Cited

U.S. PATENT DOCUMENTS 4,934,681 A * 6/1990 Holmes ..... G03G 15/23 270/58.18
5,142,340 A * 8/1992 Farrell ..... G03G 15/234 399/327
6,115,570 A * 9/2000 Kilian ..... G03G 21/181 399/111
6,842,598 B2 * 1/2005 Kibune ..... G03G 15/0121 399/223
7,693,432 B2 4/2010 Belinkov et al.
8,150,286 B2 4/2012 Yacoub et al.
(Continued)

FOREIGN PATENT DOCUMENTS

EP 2479618 7/2012
JP 2009031551 A * 2/2009

OTHER PUBLICATIONS

HP Indigo 7000 Digital Press, May 18, 2008, < http://h10032.www1.hp.com/ctg/Manual/c01493529.pdf >.

*Primary Examiner* — Leon W Rhodes, Jr.
(74) *Attorney, Agent, or Firm* — Fabian VanCott

(57) ABSTRACT

In an example, a method includes receiving, by at least one processor, an instruction to print a user specified printing task to at least one media sheet. Print operation instructions may be determined. Such print operation instructions may comprise instructions to control a print apparatus to print the user specified printing task and instructions to control a print apparatus to carry out at least one cleaning operation, wherein the cleaning operation comprises duplex printing a print media sheet.

20 Claims, 4 Drawing Sheets

(56) References Cited

U.S. PATENT DOCUMENTS

| | | | | |
|---|---|---|---|---|
| 8,285,183 | B2 * | 10/2012 | Nishida | G03G 15/2025 399/327 |
| 8,711,380 | B2 * | 4/2014 | Burry | G06F 3/1285 358/1.14 |
| 9,031,470 | B2 | 5/2015 | Kahatabi et al. | |
| 9,285,725 | B2 * | 3/2016 | Nakabayashi | G03G 15/2025 |
| 9,395,660 | B2 * | 7/2016 | Fujii | G03G 15/2025 |
| 2008/0175614 | A1 | 7/2008 | Miyazaki | |
| 2009/0324264 | A1 | 12/2009 | Boness et al. | |
| 2011/0135325 | A1 | 6/2011 | Itaka et al. | |
| 2015/0015655 | A1 | 1/2015 | Bhattacharyya et al. | |
| 2015/0071665 | A1 | 3/2015 | Lam et al. | |
| 2015/0338757 | A1 | 11/2015 | Orlik et al. | |

* cited by examiner

PRINT OPERATIONS COMPRISING USER SPECIFIED PRINTING TASKS AND CLEANING OPERATIONS

BACKGROUND

Print apparatus utilise various techniques to clean component parts in order to maintain print quality and reliability. In some print apparatus, a pattern of print agent such as toner or ink is applied to at least one pattern receiving surface prior to being transferred to a substrate. In some such examples, to clean the pattern receiving surface(s), cleaning operations, such as the printing of cleaner pages, may be carried out.

BRIEF DESCRIPTION OF DRAWINGS

Non-limiting examples will now be described with reference to the accompanying drawings, in which.

DETAILED DESCRIPTION

Some print apparatus components accumulate print agents, such as ink, toner or other debris. Over time, if untreated, the print quality or the reliability of the print apparatus may be reduced. Such effects may be seen in print apparatus for printing with various print agents, such as inks (including electronic inks) and toners, on a substrate such as paper, card, plastic metal and the like.

In some examples, a pattern of print agent is formed and applied to a substrate. For example, in some printing methods, such as those used in some Liquid Electro Photographic (LEP) printers, a pattern to be printed may first be formed as an electrostatic pattern of charges on a first pattern bearing member (which may be curved around a cylinder). Ink comprising electrically charged particles is attracted to form the pattern which may then be applied (in some examples, via an intermediate pattern bearing, or transfer, member) to a substrate.

Print materials may accumulate, for example on the regions of the pattern bearing member(s) which do not consistently receive a pattern in a particular printing task, and this can result in a reduction in print quality. In order to clean the pattern bearing member(s), cleaning cycles may be incorporated into printing. These cycles may comprise printing 'cleaner pages', in which printed patterns which may comprise a high (in some examples, close to or at 100%) coverage of at least a substantial portion of the printable area (and in some examples the whole the printable area) of a page are printed. "High coverage" may refer to the amount of ink deposited per unit area. A 100% coverage refers to printing of "solids", i.e. in a substantially continuous manner, as opposed to printing dots interspersed with unprinted substrate regions, in which case the coverage would be less than 100%. Printed images may generally have areas of varying coverage. The printable area is the maximum size of the printed area for a given print media and a given print apparatus, which may in some examples be an entire sheet, although in other examples, there may be margins or borders imposed by the print apparatus. The ink layer so formed will lift residue on the pattern bearing members, and transfer this to the printed cleaner page, which may be discarded.

Figure 1:
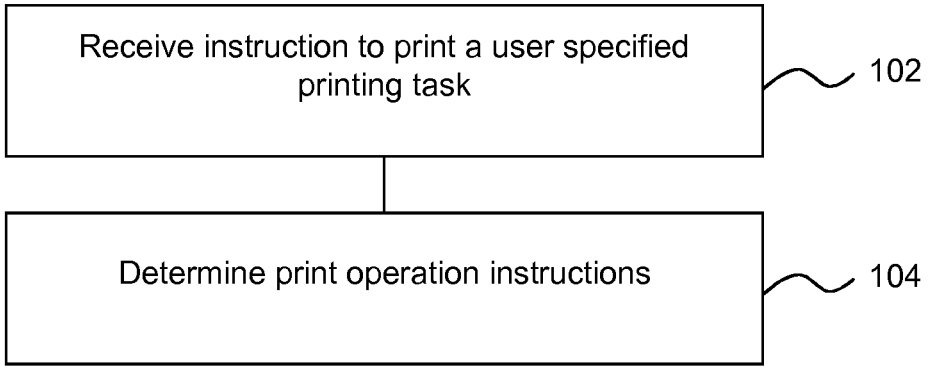
FIG. 1 is a flowchart of an example method of determining print operation instructions.

FIG. 1 is an example of a method, which may be a computer implemented method. Block 102 comprises receiving, by at least one processor, an instruction to print a user specified printing task to at least one media sheet. For example, this may comprise an instruction to print at least one image (which may comprise text or any other design), and may comprise an instruction to print one or multiple images on to one or a plurality of media sheets (for example paper, card or plastic sheets). In some examples, the user specified printing task may comprise printing an image repeatedly. The user specified printing task may specify printing on a single side of a media, or on both sides of a media sheet.

Block 104 comprises determining, by the processor, print operation instructions. The print operation instructions comprise instructions to control a print apparatus to print the user specified printing task and instructions to control a print apparatus to carry out at least one cleaning operation, wherein the cleaning operation comprises duplex printing a print media sheet. Printing the print media sheet in this way as part of cleaning operation causes a duplex, as opposed to simplex, cleaner page to be printed. In some examples, the choice of performing a cleaning operation including duplex printing a print media sheet or a cleaning operation including simplex printing of a print media sheet may be presented to a user, who may select an option for example via a user interface.

In some examples, the print operation instructions may be determined in advance of starting a print operation, or may be determined during a print operation. For example, the instructions may be to control the print apparatus to print at least one duplex cleaner page with a frequency, which may be user specified, and/or may be predetermined. For example, 1, 2 or 3 or more cleaning pages may be printed for every 100, 500, 1000, 5000 or the like user specified pages. In some examples, an instruction to carry out a cleaning operation may be determined during a print operation, for example in response to a detected reduction in image quality or user input. In some examples, the instructions to print at least one duplex printer cleaner page may be included at the end of a user specified printing task, or before the start of a user specified printing task.

Duplex printing comprises printing on both a first side and a second side of a substrate, and may be compared to simplex printing, in which a substrate is printed on just one side. Simplex printing is relatively simple to manage and optimise, whereas duplex printing can introduce some complexity, in particular as sheets may be printed out of order. For example, if sheets 1 and 2 are to be printed on both sides, instead of printing side A of sheet 1, flipping sheet 1 and printing side B before repeating with sheet 2, sides A of sheets 1 and 2 may be printed consecutively, followed by printing sides B of sheets 1 and 2: this means that sheet 1 may be flipped while side A of sheet 2 is printing, reducing idle time. This is termed 'pairing' sheets 1 and 2.

Moreover, duplex printing is associated with 'clipping', which is a reduction of the printable area of a sheet. When an image and a request to print an image using duplex printing is received, processing may be carried out to ensure that at least one border of the substrate, for example the trailing edge border, is left clear of ink. In some examples, this may comprise clipping an image to ensure that, for example, the last 4 mm of the length of a sheet, remains unprinted. This unprinted region is the region which is contacted by substrate handling mechanisms, for example grippers, and leaving this region unprinted means that the substrate handling mechanisms will not damage (for example, scratch) a portion of the image (which may be particularly vulnerable, for example being just printed and in some cases not fully dry), and that the substrate handling mechanisms themselves do not become contaminated and mark subsequent pages. A page-filling image printed using duplex printing may therefore be controlled to be shorter (for example by 4 mm) than the same image printed using simplex printing (albeit that there may also be some, generally less extensive, clipping in simplex printing).

Such clipping may reduce the extent of the printable area, and therefore, if the page were a cleaner page, the extent of the cleaning. In such an example, if the user specified printing task filled a page, and clipping was used for the cleaner pages, a margin of, say, 4 mm of the image bearing media may be left uncleaned.

There are therefore reasons for the skilled person to choose to use simplex printing for cleaning operations. However, duplex printing may also be associated with a reduction in paper use, and prevents front-to-back mis-registration.

Front-to-back mis-registration may occur when, within a print job, a first side of a page is guided by one perfector arm and then a first side of a subsequent page is guided by different perfector arm. Such perfector arm switching may occur, for example if interruptions occur within a print job, such as for example insertion of a cleaning task comprising printing a cleaner page. Generally, a 'perfector' arm may be used to control a sheet of print media after printing. If the printed page is fully printed (i.e. printed on one side for simplex printing or on both sides for duplex printing) a perfector arm may assist in delivering the media sheet towards an exit of the print apparatus. If the printed sheet has been printed on a first side and is to be printed on a second side, a perfector arm may reintroduce the sheet to a printing portion of the print apparatus. In a particular example, an image may be transferred from a cylinder, which may comprise a heated blanket, and may comprise an intermediate transfer medium, to a substrate. Such a substrate may then be captured by a perfector arm and presented to the intermediate transfer member (which may have another image applied thereto) again, this time such that the second side is towards the intermediate transfer medium.

When duplex printing is carried out as an intermediate printing operation, the arms will be in the correct position, and front-to-back mis-registration will not occur.

Figure 2:
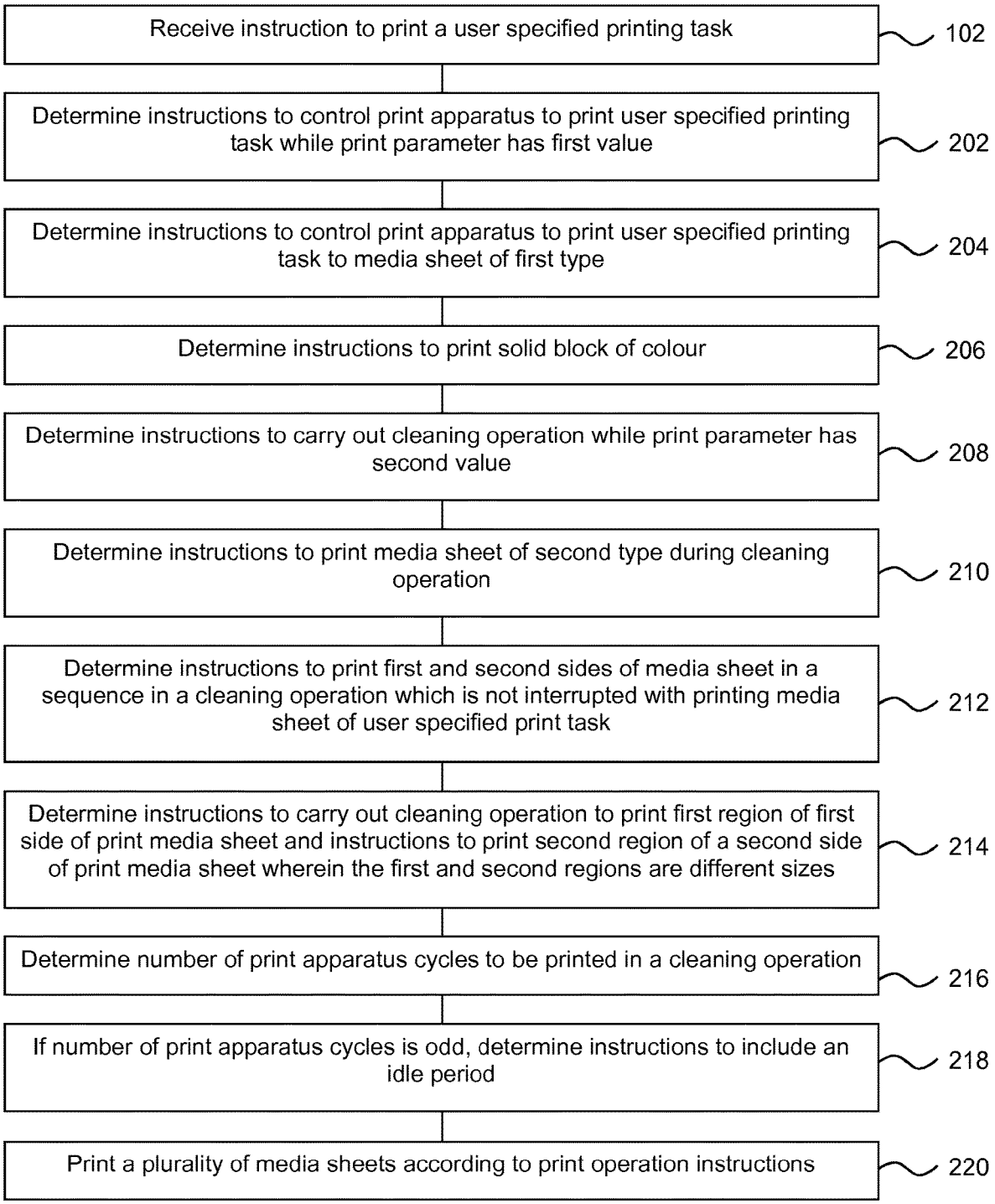
FIG. 2 is a flowchart of an example method of printing according to print operation instructions.

FIG. 2 is another example of a method. Block 102 is as described in relation to FIG. 1 above. Blocks 202 to 218 comprise one example of determining print operation instructions, for example as in block 104.

Block 202 comprises determining instructions to control the print apparatus to print the user specified printing task while a print parameter has a first value. The print parameter may for example comprise a transfer force, voltage and temperature. In some examples, a combination of parameters may be set. Block 204 comprises determining instructions to control the print apparatus to print the user specified printing task to a media sheet of a first type. For example, this may be a paper substrate having a first weight, size, shape, absorbance, ink adhesion or some other quality. The print parameters and/or the media type may be user specified, determined automatically, or the like.

Blocks 206 to 218 comprise determining instructions for printing during the cleaning operation. Block 206 comprises determining instructions to print a solid block of color, for example at a high (100% or close thereto) coverage percentage. As noted above, this may be effective for cleaning. In some examples, this may comprise printing a specific color in a page-filling manner. In some examples, the ink is an ink which has a high affinity with ink which is anticipated to form a residue to be cleaned. In block 208, instructions are determined to control the print apparatus to carry out at least one cleaning operation while the print parameter has a second value, which is different to the first value. For example, an image transfer force such as pressure or voltage may be increased so as to increase the proportion of ink transferred, a temperature of a pattern bearing surface may be increased to promote cohesion between newly applied ink and residue to be cleaned, or the like. In other examples, a print parameter may comprise a destination of the printed page, which may be set to a particular destination for cleaning operations which is different to the destination for user specified printing tasks. For example, cleaner pages could be routed to a proof tray, whereas user specified prints may be directed towards a different output. Block 210 comprises determining instructions to control the print apparatus to print to a media sheet of a second type during the cleaning operation. While in some examples, the media type may be the same for both the user specified printing task and the cleaning operation, in this example a different media type is used. For example a media type used in cleaning operations may have a larger sheet size (so as to effect cleaning over a larger area), and in some examples the largest available sheet size may be used. In other examples, media having an increased ink adhesion property compared to that used for the user specified printing task may be used to promote transfer of the ink to the substrate. In some examples, the media type may be changed if the first media type is unsuited to cleaning operations.

Block 212 comprises determining instructions to print a first and second side of a media sheet in the cleaning operation in a sequence which is not interrupted with printing a media sheet of the user specified printing task. Printing cleaner pages consecutively provides more complete cleaning than if printing of such pages is interspersed with printing pages according to the user specified printing task. Viewed another way, block 212 may comprise ensuring that cleaning pages are not 'paired' with user specified printing task pages, and may therefore be a constraint imposed on a pairing algorithm (although cleaner pages may be paired with other cleaner pages). This may increase the efficacy of cleaning. In some examples, the user specified printing task and/or the duplex printing of the cleaning operation may comprise pairing pages such that printing is carried out with an order as follows: (i) a first side of a first page is printed, (ii) a first side of a second page is printed (iii) the second side of the first page is printed; (iv) the second side of the second page is printed. Such pairing may be carried out with the constraint of block 212.

Block 214 comprises determining instructions to carry out at least one cleaning operation comprising instructions to print to a first region of a first side of a print media sheet and instructions to print to a second region of a second side of the print media sheet, wherein first region and the second region are of different sizes.

In particular examples, the processor may control the print apparatus such that 'clipping' (or clipping to a particular extent) is applied to one side of a media sheet in a cleaning operation and not to the other side. When printing on a first side of a sheet, the sheet may be secured with grippers which act on the unprinted side. However, when the page is reversed in duplex printing, the grippers will act on a previously printed side of the paper. Therefore, the region of the paper which will be gripped when the sheet is reversed may be kept free of print agent when printing the first side, so that the printed portion is not scratched, and does not transfer ink to the grippers. Clipping is usually applied to the trailing edge, which becomes the leading edge when the page is reversed for printing on the second side. In some examples, clipping may also be applied to other edges.

Clipping in the user specified print task may be carried out on both sides if the user specified printing task is a duplex printing task. This simplifies tasks such as image placement. However, block 214 may comprise carrying out such clipping in relation to just one side, as the second side to be printed will not subsequently be acted on by the grippers so is not subject to damage and/or ink transfer in the same way. More generally, in some examples, instructions to print the user specified print task may comprise instructions to print to a first region of a first side of a print media sheet and to a second region of a second side of the print media sheet, wherein first region and the second region are of the same size (for example, clipping may be applied when printing both sides of a sheet), whereas in the cleaning operation, these regions may be of different sizes. In some examples, this may comprise an image processing operation, rather than a direct print apparatus control operation.

While removing or reducing clipping from one side will increase the cleaning region, the region of the print apparatus to be cleaned which underlies the border region (or more generally any region which is covered by the pattern for transferring to one side of a media sheet and not the other) will be cleaned with a duty cycle of 50% of the cleaning of the rest of the area. While this may be sufficient in some examples, in other examples, the number of cleaning pages may be set such that any such region is sufficiently cleaned.

In some examples, in order to reduce consumption of print agent while ensuring adequate cleaning, the regions of one side of the media sheet which are printed may be selected so as to clean a region of the apparatus which is at least substantially different to region cleaned by the other side of the media sheet. For example, 'half pages' could be printed. This would mean that, although the same number of media sheets would be consumed as for simplex cleaner pages, as duplex printing is carried out, 'front to back' mis-registration would not occur as explained above.

Block 216 comprises determining a number of print apparatus cycles to be carried out in a cleaning operation and, if the number is odd, determining instructions to include an idle period corresponding to a print apparatus cycle (or cycle time) in block 218. In other words, the method comprises inserting an instruction for an idle cycle if the number of print apparatus cycles would otherwise be odd. A print apparatus cycle may for example comprise the actions taken to print a print separation, or to a corresponding time period. A print separation comprises the application of a single color. To consider an example, an image may be made up of four color separations: Cyan, Yellow, Magenta and Black. Patterns formed in each of those colors may be overlaid on an intermediate transfer member or directly on a substrate. However, it may be the case that a print apparatus cycle occurs without a separation being printed. In some examples, determining the number of print apparatus cycles may comprise monitoring a print cycle counter during a cleaning operation and, if the counter is indicative of an odd number, inserting an idle cycle 'on the fly' following completion of the cleaning operation, before resuming a user defined print task.

As is also discussed in relation to FIG. 5 below, in some print apparatus, it has been proposed to use at least a first and a second print agent (e.g. different colored electronic inks) and to provide an electrostatic imaging cylinder on which print agent patterns are formed. The electrostatic imaging cylinder is conceptually formed of a first semicylinder and a second semicylinder, wherein each semicylinder is to receive one of the first print agent and second print agent. Minor differences can occur over different semicylinders and therefore it can be intended, for the sake of color consistency between printed images, that if a particular print agent (e.g. a particular color such as Cyan, Yellow, Magenta and Black) is applied using the first semicylinder, that the associated semicylinder remains consistent for a complete print operation.

In this way, a single color separation may be associated with half a cylinder. Integer rotations of the cylinder maintain a consistent link between the print agents and the semicylinder, therefore if an odd number of print separations has been applied in a cleaning operation, an idle period which may be equal to a half rotation of the imaging period (or more generally, $n+\frac{1}{2}$, where n is 0 or a positive integer, although shorter idle periods will allow quicker print operations), may be inserted into the print operation.

This in turn may allow a cleaning operation to be inserted into a user specified printing task (as opposed to, for example, held to an end of such a task) without risk of switching the semicylinder associated with a particular print agent.

In some examples, block 218 may comprise inserting at most one idle period into the cleaning operation.

Block 220 comprise printing a plurality of media sheets according to the print operation instructions.

Figure 3:
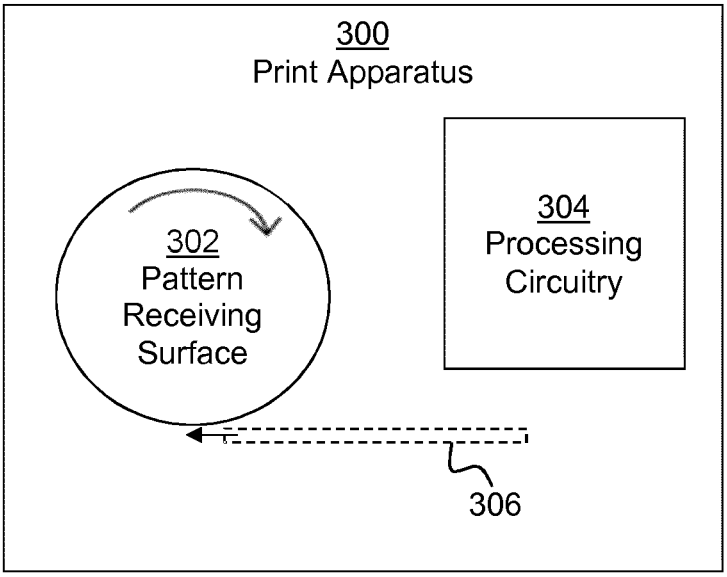
FIGS. 3 and 4 are schematic diagrams of example print apparatus.

FIG. 3 shows an example of a print apparatus 300 comprising a pattern receiving surface 302 (in this example, a cylinder) and processing circuitry 304.

The pattern receiving surface 302 receives a pattern of print agent according to print instructions. For example, this may be applied directly thereto from a print agent source or, as discussed in relation to FIG. 4 below, be transferred from an electrostatic imaging plate. The pattern receiving surface 302 transfers the pattern of print agent to a print media sheet 306 (shown in dotted line as this is not part of the apparatus 300).

The processing circuitry 304 receives an instruction to print a user specified printing task (for example, at least one image, text portion, pattern or the like) to at least one media sheet. The processing circuitry 304 also controls the print apparatus 300 to carry out a print operation comprising the user specified printing task, and schedules, within the print operation, a cleaning operation, wherein the cleaning operation comprises duplex printing at least one print media sheet.

In some examples, the processing circuitry 304 may carry out the method of FIG. 1 or of any block of FIG. 2. For example, the processing circuitry 304 may schedule a cleaning operation such that cleaning operation prints are interleaved, or interspersed, with other cleaning prints and not with non-cleaning prints, for example as described in relation to block 212 above.

Figure 4:
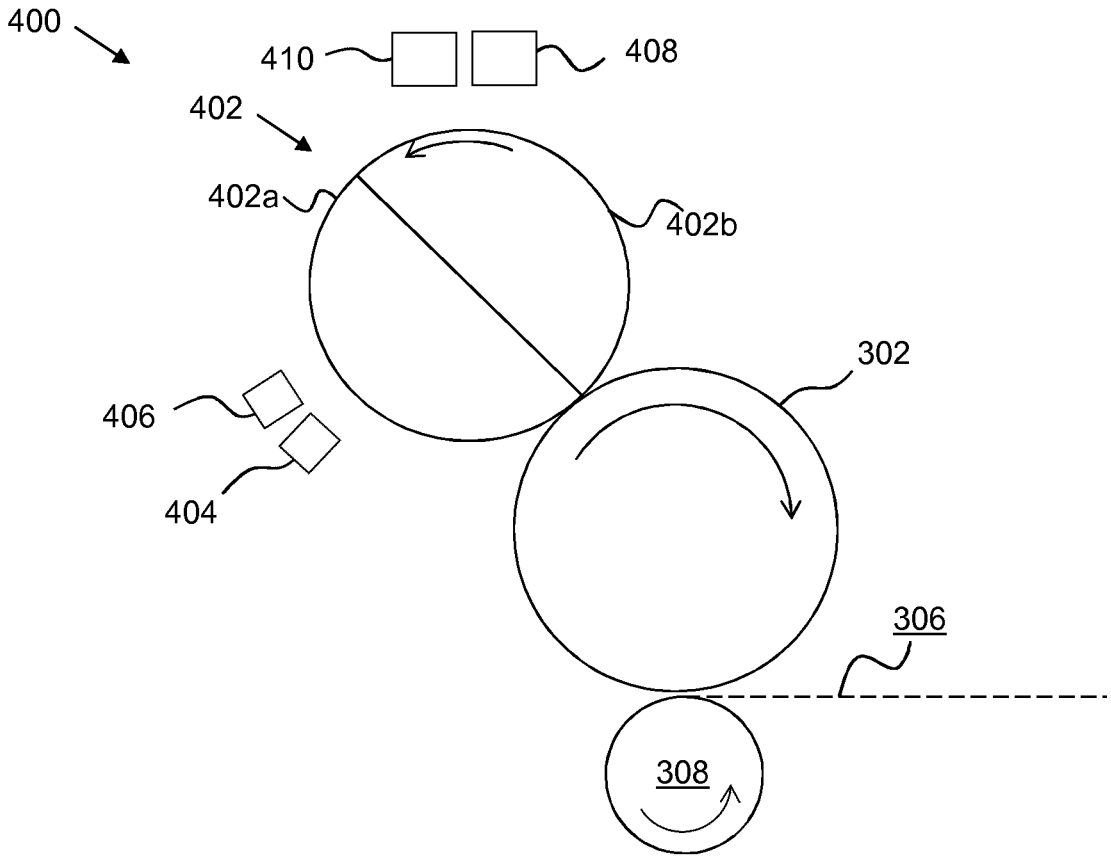

FIG. 4 shows another example of a printing apparatus 400. The printing apparatus 400 comprises, in addition to the components described in relation to FIG. 3, an electrostatic imaging plate, in this example wrapped to form an electrostatic imaging cylinder 402, a first print agent source 404 and second print agent source 406.

In this example, the print apparatus 400 is a Liquid Electro Photographic (LEP) printing apparatus which may be used to print a print agent such as an electrostatic ink composition (or more generally, an electronic ink). A charging unit 408 deposits a uniform charge on the electrostatic imaging plate, which in this example is a photo imaging plate, or 'PIP' of the electrostatic imaging cylinder 402 and then a photo imaging unit 410 (for example, comprising at least one laser or LED) dissipates the static charges in selected portions of the image area on the PIP to leave a latent electrostatic image. The latent electrostatic image is an electrostatic charge pattern representing the pattern to be printed. The electrostatic ink composition is then transferred to the PIP from a first or second print agent source 404, 406, which may comprise a Binary Ink Developer (BID) unit, and which may present a uniform film of the print agent to the PIP. The print agent may be electrically charged by virtue of an appropriate potential applied to the print agent in the print agent source 404, 406. The charged resin component, by virtue of an appropriate potential on the electrostatic image areas, is attracted to the discharged portions of the on the PIP. The print agent does not adhere to the charged, non-image areas and forms a pattern on the surface of the latent electrostatic image. Ink is not transferred to non-image areas because there is a potential difference between non-discharged PIP and BID that opposes transfer of charged ink. The electrostatic imaging cylinder 402 will thereby acquire a developed print agent electrostatic ink composition pattern on its surface.

The electrostatic imaging cylinder 402 comprises a first semicylinder 402*a* and a second semicylinder 402*b*, wherein each semicylinder 402*a*, 402*b* is to receive print agent from one of the first print agent source 404 and the second print agent source 406. In this example, the processing circuitry 304 is configured to control the print operation such that, for the duration of the print operation, the first semicylinder 402*a* receives print agent from the first print agent source 404 and the second semicylinder 402*b* receives print agent from the second print agent source 406.

Each print agent source 404, 406 provides agent to form a pattern of print agent on the electrostatic imaging cylinder 402. The image is then transferred from the electrostatic imaging cylinder 402 to the pattern receiving surface 302, which comprises an intermediate transfer member (ITM), by virtue of an appropriate potential and force applied between the electrostatic imaging cylinder 402 and the pattern receiving surface 302, such that the charged print agent is attracted to the pattern receiving surface 302. The image is then dried and fused on the pattern receiving surface 302 before being transferred to the print media sheet 306 (for example, adhering to the colder surface thereof), which is passed between the pattern receiving surface 302 and an impression cylinder 308. In some examples, the pattern receiving surface 302 is heatable. For duplex printing, the media sheet 306 is passed back to the impression cylinder 308, and urged against the pattern receiving surface 302 again, with the opposite side towards the pattern receiving surface 302 (which will bear a fresh layer of print agent to form an image on the reverse side).

Figure 5:
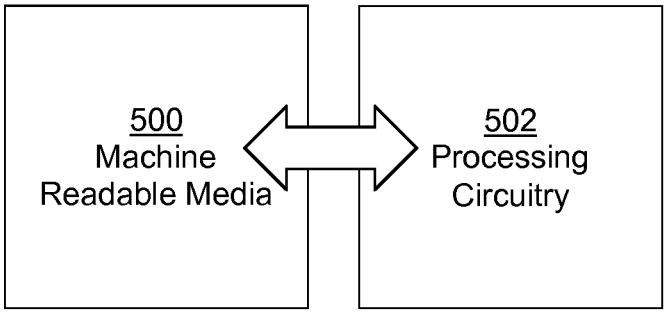
FIG. 5 is an example of a machine readable medium in conjunction with processing circuitry.

FIG. 5 is an example of a machine readable media 500 in association with processing circuitry 502. The machine readable media 500 comprises instructions which, when executed by the processing circuitry 502, cause the processing circuitry 502 to determine a print scheduling for a received print job, the print scheduling comprising the received print job and a duplex media sheet cleaning print operation and being determined such that cleaning print operations are interleaved (interspersed) with other cleaning print operations and not with print operations of the received print job.

In some examples, the machine readable media 500 may further comprise instructions which, when executed by the processing circuitry 502, cause the processing circuitry 502 to determine a print scheduling such that a duplex media sheet cleaning print operation comprises an instruction to include an idle cycle if the number of print apparatus cycles would otherwise be odd. For example, the cleaning print operation may comprise printing an odd number of color separations and include one idle period, or no idle period if performing the duplex media sheet cleaning print operation comprises printing an even number of color separations. However, it may be noted that the print apparatus cycles may comprise activities other than printing color separations, such as idle cycles, preparation, or the like.

Examples in the present disclosure can be provided as methods, systems or machine readable instructions, such as any combination of software, hardware, firmware or the like. Such machine readable instructions may be included on a computer readable storage medium (including but not limited to disc storage, CD-ROM, optical storage, etc.) having computer readable program codes therein or thereon.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that at least some blocks in the flow charts, as well as combinations of the blocks in the flow charts can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method comprising:

receiving, by at least one processor, an instruction to print a user specified printing task to at least one media sheet; and determining, by the processor, print operation instructions, the print operation instructions comprising instructions to control a print apparatus to print the user specified printing task and instructions to control a print apparatus to carry out at least one cleaning operation, wherein the cleaning operation comprises duplex printing a print media sheet that is a cleaner page to adhere and remove residue from a component of the print apparatus, the print operation instructions further comprising instructions to rearrange an order of print media sheet sides being printed in which multiple first sides of print media sheets are printed before second sides of those print media sheets with a constraint, imposed by a pairing function of the processer, that the cleaning operation has a sequence of print media sides of cleaner pages to be printed that is not interrupted with printing part of the user specified printing task.

2. A method according to claim 1 further comprising:

printing a plurality of media sheets according to the print operation instructions including pages of the user specified printing task and at least one cleaner page.

3. A method according to claim 1 in which determining the print operation instructions comprises determining instructions to print a duplex cleaner page at a predetermined frequency, one duplex cleaner page per specified amount of pages of the user specified printing task.

4. A method according to claim 1 wherein determining the print operation instructions comprises:

determining instructions to control the print apparatus to print the user specified printing task wherein the instructions to control the print apparatus to print the user specified printing task include a print parameter which has a first value for printing the user specified printing task; and determining instructions to carry out at least one cleaning operation, wherein the instructions to carry out the at least one cleaning operation include the print parameter which has a second value for carrying out the cleaning operation, and wherein the second value is different to the first value.

5. A method according to claim 4 wherein the print parameter comprises at least one of a transfer force, a voltage, and a destination of a media sheet.

6. A method according to claim 1 wherein:

determining the print operation instructions comprises determining instructions to control the print apparatus to print the user specified printing task to a media sheet of a first type; and determining the print operation instructions comprises determining instructions to carry out at least one cleaning operation by duplex printing to a media sheet of a second type, wherein the second type is different to the first type.

7. A method according to claim 1 wherein the instructions to carry out at least one cleaning operation comprise instructions to print a solid block of color.

8. A method according to claim 1 wherein determining the print operation instructions comprises determining instructions to print to a first region of a first side of the print media sheet in the cleaning operation and instructions to print to a second region of a second side of the same print media sheet in the cleaning operation, wherein the first region and the second region are of different non-zero sizes.

9. A method according to claim 1 further comprising inserting an idle cycle in the cleaning operation when the cleaning operation comprises an uneven number of print media sides of cleaner pages to be printed.

10. A method according to claim 1 wherein the print apparatus comprises an electrostatic imaging cylinder conceptually divided into a first semicylinder and a second semicylinder, each semicylinder receiving different print agent.

11. A method according to claim 10 wherein the constraint further specifies that the sequence of print media sides printed for the cleaning operation is not allowed to switch the print agent being used with one of the semicylinders to the other semicylinder.

12. A method according to claim 1 wherein the cleaning operation comprises an odd number of different color separations and one idle period.

13. A method according to claim 1, wherein printing of the cleaner pages is performed after some of the user specified printing task is printed and before a remainder of the user specified printing task is printed.

14. Print apparatus comprising:

a pattern receiving surface to receive a pattern of print agent according to print instructions, and to transfer the pattern of print agent to a print media sheet;

processing circuitry, wherein the processing circuitry is to:

receive an instruction to print a user specified printing task to at least one media sheet;

control the print apparatus to carry out a print operation comprising the user specified print task; and schedule, within the print operation, a cleaning operation, wherein the cleaning operation comprises duplex printing at least one print media sheet, wherein the duplex printing comprises printing to a first region of a first side of the at least one print media sheet in the cleaning operation and printing to a second region of a second side of the at least one print media sheet in the cleaning operation, wherein the first region and the second region are of different non-zero sizes;

an electrostatic imaging cylinder to receive print agent to form the pattern of print agent and to transfer the pattern to the pattern receiving surface; and a first print agent source and a second print agent source and in which the electrostatic imaging cylinder comprises a first semicylinder and a second semicylinder, wherein each semicylinder is to receive print agent from one of the first and second print agent source, and wherein the processing circuitry is to control the print operation such that, for the print operation, the first semicylinder receives print agent from the first print agent source and the second semicylinder receives print agent from the second print agent source.

15. Print apparatus according to claim 14 wherein the processing circuitry is to schedule a cleaning task operation such that cleaning operation prints are interleaved with other cleaning prints and not with non-cleaning prints.

16. Print apparatus according to claim 14, wherein a single color separation is associated with the first semicylinder.

17. A non-transitory machine readable media comprising instructions which, when executed by processing circuitry, cause the processing circuitry to determine a print scheduling for a received print job, the print scheduling comprising the received print job and a duplex media sheet cleaning print operation, the print scheduling including rearranging an order of print media sheet sides being printed in which multiple first sides of print media sheets are printed before second sides of those print media sheets with a constraint in the scheduling instructions that the sheet cleaning print operation has a sequence of print media sides of cleaner pages to be printed that is not interrupted with printing part of the received print job.

18. The non-transitory machine readable media of claim 17 further comprising instructions which, when executed by processing circuitry, cause the processing circuitry to determine a print scheduling such that:

a duplex media sheet cleaning print operation comprises an idle period if the number of print apparatus cycles would otherwise be odd; and/or idle periods associated with duplex printing are minimized using page pairing, given that cleaning print operations are not interleaved with print operations of the received print job.

19. The non-transitory machine readable media of claim 17 wherein the duplex media sheet cleaning print operation comprises printing to a first region of a first side of a print media sheet in the duplex media sheet cleaning print operation and printing to a second region of a second side of the print media sheet in the duplex media sheet cleaning print operation, wherein the first region and the second region are of different non-zero sizes.

20. Print apparatus comprising:

a pattern receiving surface to receive a pattern of print agent according to print instructions, and to transfer the pattern of print agent to a print media sheet;

processing circuitry, wherein the processing circuitry is to:

receive an instruction to print a user specified printing task to at least one media sheet;

control the print apparatus to carry out a print operation comprising the user specified print task; and schedule, within the print operation, a cleaning operation, wherein the cleaning operation comprises duplex printing at least one print media sheet, wherein the duplex printing comprises printing to a first region of a first side of the at least one print media sheet in the cleaning operation and printing to a second region of a second side of the at least one print media sheet in the cleaning operation, wherein the first region and the second region are of different non-zero sizes;

wherein the processing circuitry is to rearrange an order of print media sheet sides being printed in which multiple first sides of print media sheets are printed before second sides of those print media sheets, the processing circuitry programmed with an express constraint that the cleaning operation has a sequence of print media sides of cleaner pages to be printed that is not interrupted with printing part of the user specified printing task.

* * * * *